US005228873A

United States Patent [19]

Hirai

[11] Patent Number: 5,228,873

[45] Date of Patent: Jul. 20, 1993

[54] METALLIC-SHELL-EQUIPPED ELECTRICAL CONNECTOR

[75] Inventor: Yuji Hirai, Tokyo, Japan

[73] Assignee: Honda Tsushin Kogyo Kabushiki Kaisha, Tokyo, Japan

[21] Appl. No.: 868,178

[22] Filed: Apr. 14, 1992

[30] Foreign Application Priority Data

Feb. 28, 1992 [JP] Japan ..... 4-9928[U]

[51] Int. Cl.[5] ..... H01R 13/73; H01R 13/648

[52] U.S. Cl. ..... 439/607; 439/573

[58] Field of Search ..... 439/571, 573, 607, 608, 439/609

[56] References Cited

U.S. PATENT DOCUMENTS 5,125,853 6/1992 Hashiguchi ..... 439/607

5,163,851 11/1992 Hart et al. ..... 439/607

*Primary Examiner*—Gary F. Paumen

*Attorney, Agent, or Firm*—Armstrong, Westerman, Hattori, McLeland & Naughton

[57] ABSTRACT

A electrical connector main body of a metallic-shell-equipped connector has a pair of right and left mounting portions, and each of the mounting portions has a perforation on its upper end. An electrically conductive nut-like member is fitted into the perforation. An electrically conductive plate member or an electrically conductive mounting member is fitted into the perforation in contact with an end surface of the nut-like member. A metallic shell which has projections on its internal surface is fitted onto or into a surface of the connector main body so that the projections contact the periphery of the nut-like member. Part of the electrically conductive plate member or an electrically conductive mounting member is electrically connected to an electrically conducting portion of a printed wiring board by bolting or by soldering.

5 Claims, 7 Drawing Sheets

METALLIC-SHELL-EQUIPPED ELECTRICAL CONNECTOR

BACKGROUND OF THE INVENTION

This invention relates to a metallic-shell-equipped electrical connector (i.e., a connector which is equipped with a metallic shell).

A conventional metallic-shell-equipped electrical connector comprises, as shown in FIG. 12, a connector main body "a" which has a perforation b, an L-shaped metallic plate piece d which has formed therein a burring tap c and is fitted into the connector main body "a", and a metallic shell e which is fitted over or into the surface of the connector main body "a". In this arrangement, by inserting a bolt g which is fitted into a hole f in the connector main body "a" into the burring tap c, the metallic shell e is electrically connected for grounding to an electrically conducting portion k of a printed wiring board j which is attached to the connector by a bolt h and a nut i via the L-shaped metallic piece d. Numeral 1 denotes a panel to which the connector is attached with the bolt g.

Since the above-mentioned conventional connector uses the L-shaped metallic piece d which has formed therein a burring tap, it has a disadvantage in that the cost of the connector becomes high.

OBJECT AND SUMMARY OF THE INVENTION

This invention has an object of providing a metallic-shell-equipped electrical connector which solves the above-mentioned disadvantage.

In order to attain the above-mentioned object, according to a first aspect of this invention, there is provided a metallic-shell-equipped connector comprising: a connector main body having a pair of right and left mounting portions, each of the mounting portions having a perforation; an electrically conductive nut-like member which is fitted into the perforation; an electrically conductive plate member which is fitted into the perforation in contact with an end surface of the nut-like member and is disposed along a lower surface of the connector main body; and a metallic shell which is fitted over a surface of the connector main body in contact with a periphery of the nut-like member.

According to a second aspect of this invention, there is provided a metallic-shell-equipped connector comprising: a connector main body having a pair of right and left mounting portions, each of the mounting portions having a perforation; an electrically conductive nut-like member which is fitted into the perforation; an electrically conductive mounting member comprising a connector main body fixing portion which is fitted into the perforation in contact with an end surface of the nut-like member; and a metallic shell which is fitted onto a surface of the connector main body in contact with a periphery of the electrically conductive nut-like member.

According to a third aspect of this invention, there is provided a metallic-shell-equipped connector according to the second aspect of this invention: wherein the electrically conductive mounting member is a plate-like lock and hold-down member which is integrally made up of a pair of wing pieces, a locking portion having two pieces of branched pieces provided on each of their outer sides with a locking projection, and a board-fixing portion; wherein one of the pair of wing pieces is fitted into the perforation in contact with the electrically conductive nut-like member; wherein the two pieces of branched pieces of the board-locking portion are electrically connected to an electrically conductive portion of a printed wiring board when the two pieces of branched pieces are inserted into a throughgoing hole in the printed wiring board and are engaged with an edge of the throughgoing hole by soldering; and wherein the board-fixing portion is electrically connected to the electrically conducting portion of the printed wiring board when the board-fixing portion is soldered to the electrically conducting portion.

According to a fourth aspect of this invention, there is provided a metallic-shell-equipped connector according to the second aspect of this invention: wherein the electrically conductive mounting member is a plate-like hold-down member which is integrally made up of a pair of wing pieces and a board-fixing portion; wherein one of the pair of wing pieces is fitted into the perforation in contact with the electrically conductive nut-like member; and wherein the board-fixing portion is electrically connected to an electrically conductive portion of a printed wiring board when the board-fixing portion is soldered to the electrically conductive portion.

According to a fifth aspect of this invention, there is provided a metallic-shell-equipped connector according to the second aspect of this invention wherein the electrically conducting mounting member is a plate-like lock member which comprises, on one end, a locking portion having two pieces of branched pieces provided on each of outer sides with a locking projection and, on the other end, a connector main body fixing portion; wherein the connector main body fixing portion is fitted into the perforation in contact with the electrically conductive nut-like member; and wherein the locking portion is electrically connected to an electrically conductive portion of a printed wiring board when the two pieces of branched pieces are fitted into a throughgoing hole in the printed wiring board and are engaged with an edge of the throughgoing hole by soldering.

In the metallic-shell-equipped connector of the first aspect through the fifth aspect of this invention, the metallic shell which is fitted over the surface of the connector is electrically connected to the electrically conducting plate member or the electrically conducting mounting member via the electrically conductive nut-like member. Therefore, when the connector is mounted on the printed wiring board, the metallic shell is electrically connected to the electrically conducting portion of the printed wiring board through the electrically conductive nut-like member and the electrically conducting plate member or the electrically conducting mounting member. Since the electrically conductive nut-like member can be manufactured or obtained at a low cost, the overall cost of the connector can also be made low.

BRIEF DESCRIPTION OF THE DRAWINGS

The above and other objects and the attendant advantages of this invention will become readily apparent by reference to the following detailed description when considered in conjunction with the accompanying drawings wherein.

DETAILED DESCRIPTION OF PREFERRED EMBODIMENTS

Figure 1:
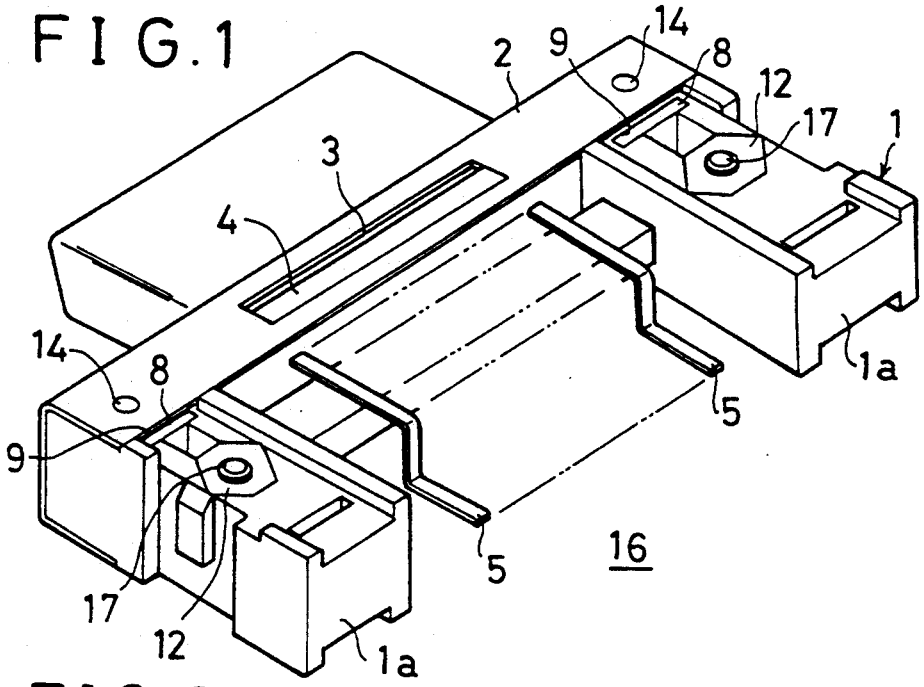
FIG. 1 is a perspective view of one example of a connector of this invention, in which a bolt and a nut are used for mounting the connector on a printed wiring board.
Figure 2:
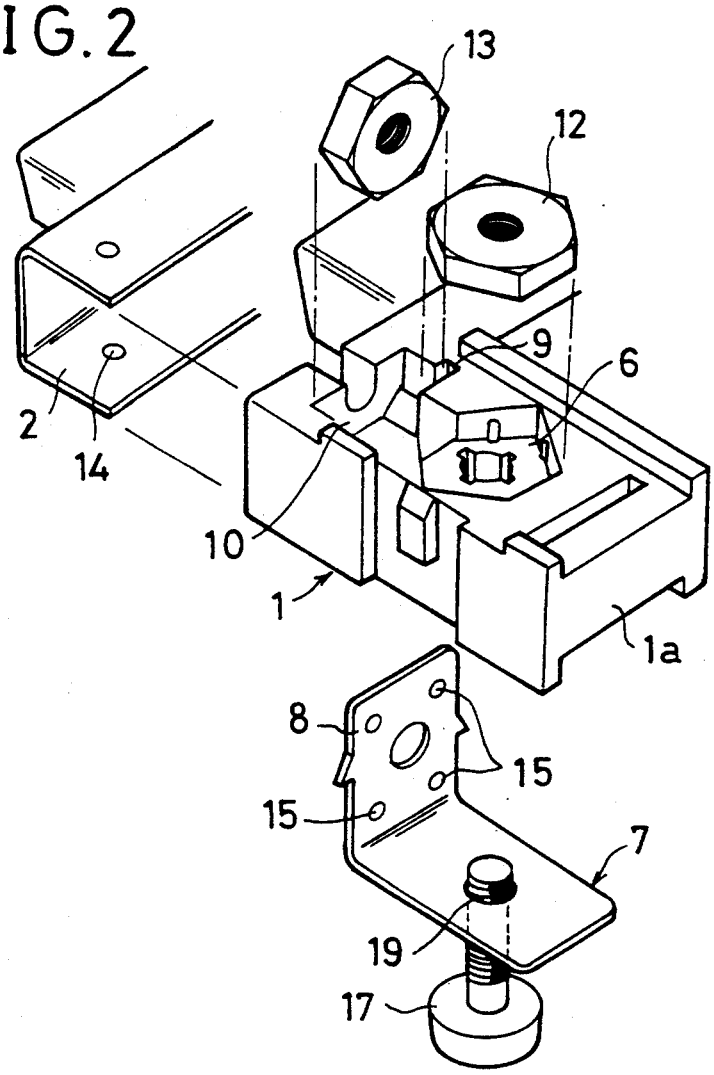
FIG. 2 is an exploded perspective view of an important portion of the connector shown in FIG. 1.
Figure 3:
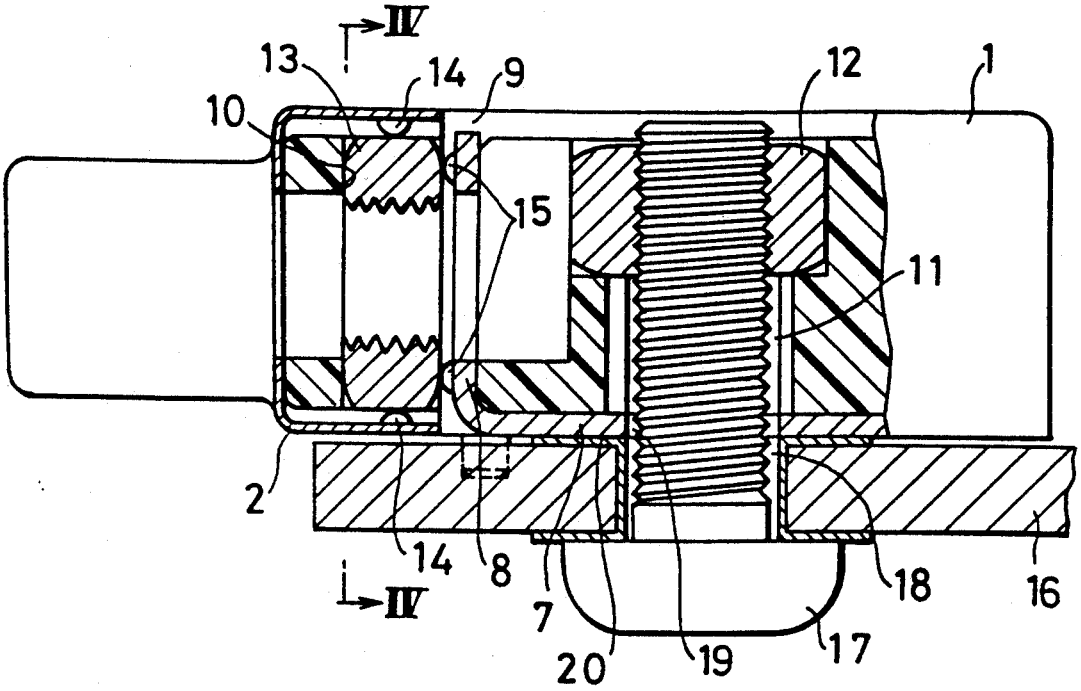
FIG. 3 is a sectional view of an important portion of the connector shown in FIG. 1.
Figure 4:
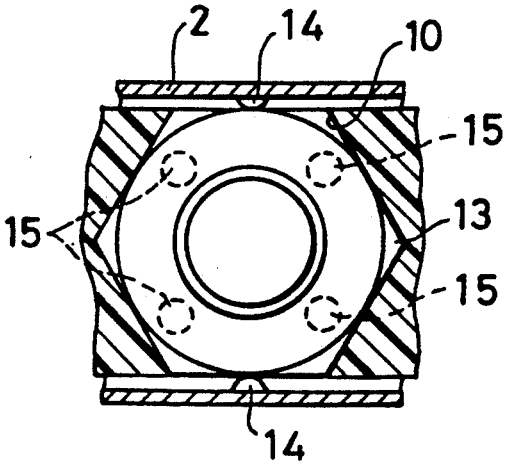
FIG. 4 is a sectional view taken along the line IV—IV of FIG. 3.

Preferred embodiments of this invention will now be explained with reference to the accompanying drawings.

FIGS. 1 through 4 show one example of a electrical connector of this invention which uses bolts and nuts for mounting the connector on a printed wiring board.

In these figures, numeral 1 denotes a connector main body which is made up of a synthetic resin and has a pair of right and left mounting portions 1*a*, 1*a*. Numeral 2 denotes a metallic shell which is fitted onto or into that fitting portion of the connector main body 1 which fits into a mating connector as well as onto or into an adjoining surface of the connector main body. The notched portion 3 of the metallic shell 2 is engaged with a projection 4 on the connector main body 1. Numeral 5 denotes electric contacts. On an upper surface of each of the mounting portions 1*a*, 1*a* of the connector main body 1, there are formed a dented portion 6 for placing a nut for mounting the connector on a printed wiring board, a perforation 9 for fitting thereinto a vertical piece 8 of an L-shaped metallic plate 7, and a perforation 10, which is in communication with the perforation 9, for fitting a nut-like member thereinto. At the bottom of the dented portion 6, there is provided a perforation 11 for inserting a bolt.

A nut 12 is placed into the dented portion 6, an electrically conductive nut-like member 13 is fitted into the perforation 10, and the vertical piece 8 of the L-shaped metallic plate 7 is inserted from below the connector main body 1 into the perforation 9, and the metallic shell 2 is fitted over or into the connector main body 1. On that portion of the metallic shell 2 which faces the nut-like member 13, there are provided inward projections 14. Therefore, the metallic shell 2 contacts the periphery of the nut-like member 13 via the projections 14. The vertical piece 8 of the L-shaped metallic piece 7 is provided with projections 15. Therefore, an end surface of the nut-like member 13 contacts the vertical piece 8.

It follows that, when the connector shown in FIG. 1 is placed on a printed wiring board 16, and a bolt 17 is inserted from below through a throughgoing hole 18, a hole 19 in the L-shaped metallic plate 7 and the perforation 11 to screw it into the nut 12, the metallic shell 2 is electrically connected via the nut-like member 13 and the L-shaped metallic plate 7 to an electrically conducting portion 20 of the printed wiring board 16 and is grounded.

Figure 5:
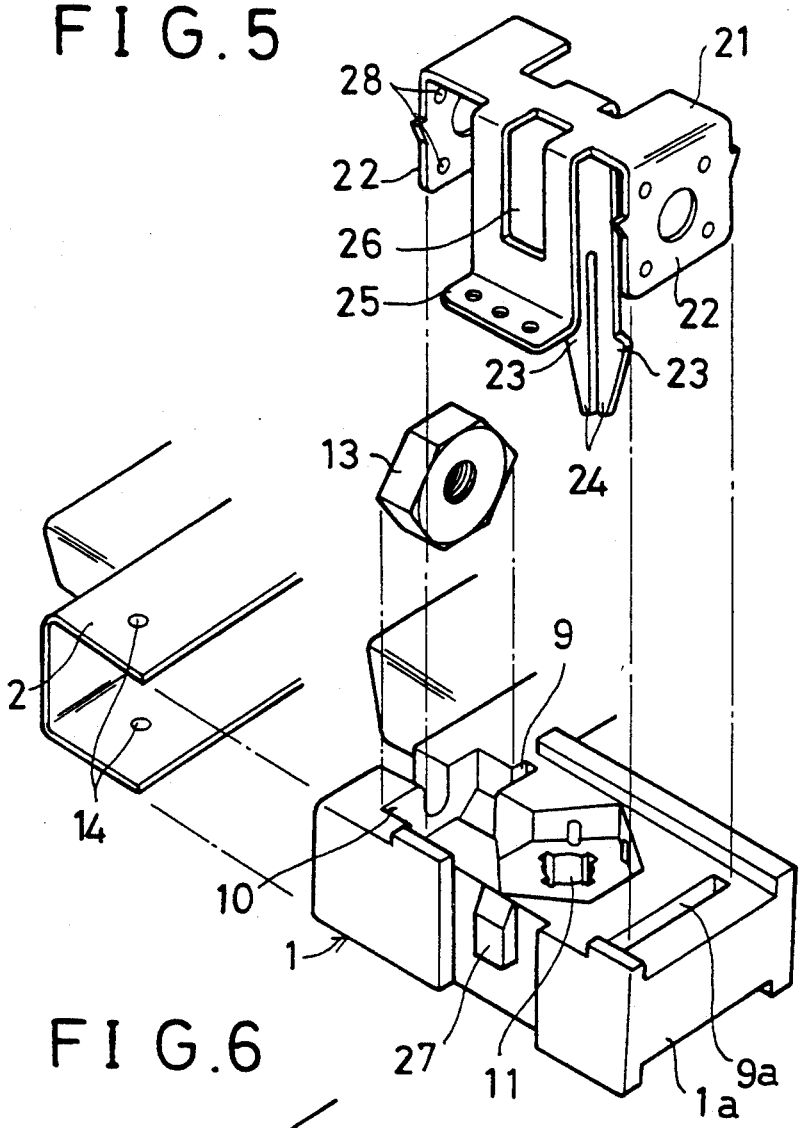
FIG. 5 is an exploded perspective view of an important portion of another embodiment of the connector of this invention, in which a plate-like lock and hold-down member is used for mounting the connector on a printed wiring board.
Figure 6:
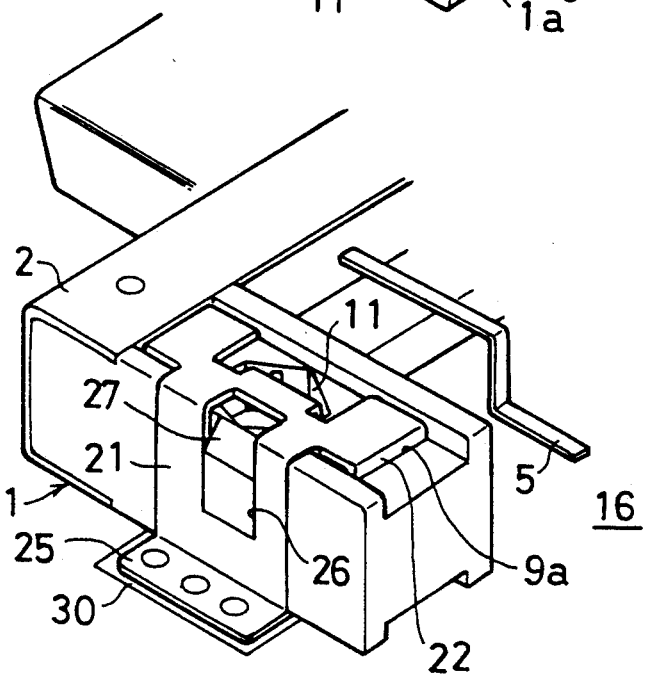
FIG. 6 is a perspective view of an important portion of the embodiment shown in FIG. 5.
Figure 7:
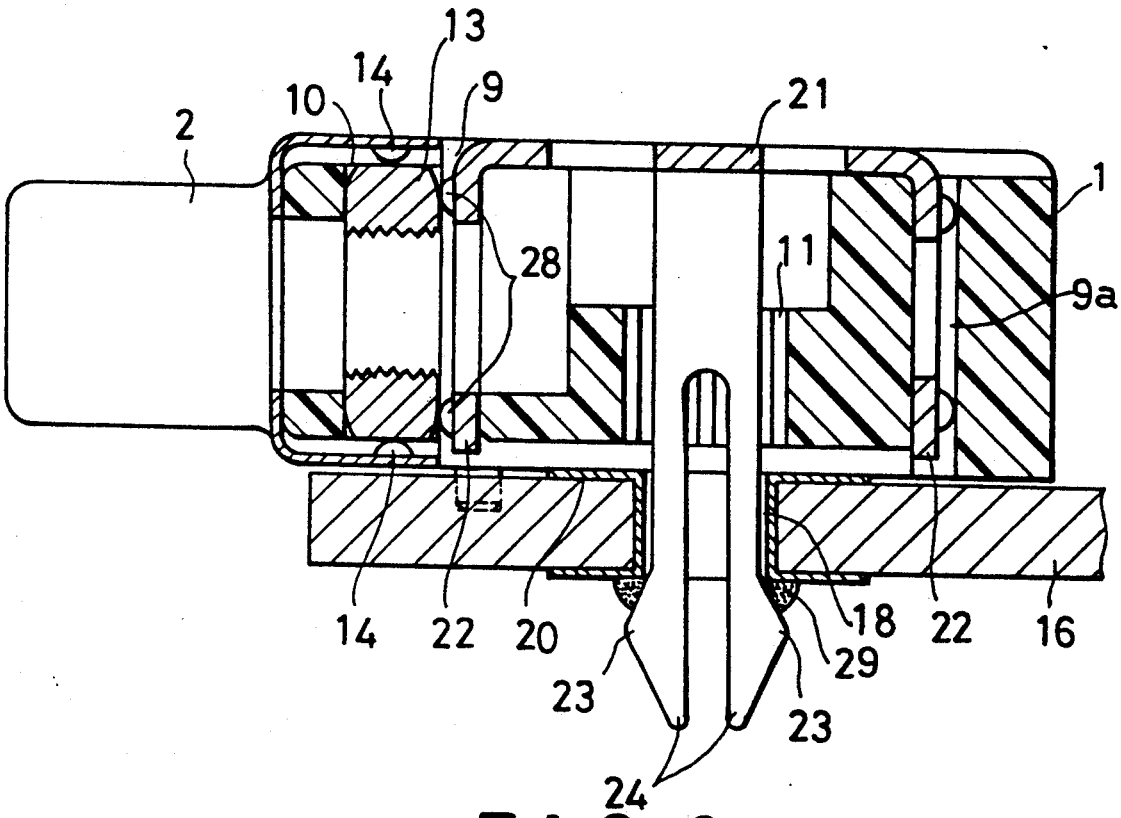
FIG. 7 is a sectional view of an important portion of the embodiment shown in FIG. 5.

FIGS. 5 through 7 show a connector according to another embodiment of this invention, in which an electrically conductive mounting member for mounting the connector on a printed wiring board, in the form of a plate-like lock and hold-down member, is used for mounting the connector on the printed wiring board.

The plate-like lock and hold-down member 21 is made up of a metallic plate and comprises, as is clearly shown in FIG. 5, a parallelly provided wing pieces 22, 22 on both ends of one direction. These wing pieces serve as connector main body fixing portion, i.e., a portion for fixing the connector main body to the printed wiring board. Between these wing pieces there are integrally formed a board-locking portion (i.e., a portion for locking the connector to the printed wiring board) comprising two pieces of branched pieces 24, 24 which are provided on each of their outer sides with a locking projection 23. On the remaining end, which is opposite to the board-locking portion of the lock and hold-down member 21, there is formed a board-fixing portion 25 (i.e., a portion for fixing the connector to the printed wiring board). The pair of wing pieces 22, 22 are inserted into the perforation 9 and anther perforation 9*a* which is in parallel therewith, both in the connector main body 1. The branched pieces 24, 24 are inserted into the perforation 11 for mounting the lock and hold-down member 21 on the connector main body 1. When the pair of wing pieces 22, 22 are inserted down to their bottoms into the perforations 9, 9*a*, the bottom edge of a window 26 in the board-fixing portion 25 is engaged with the lower surface of a projection 27 on the connector main body 1, thereby securing the board-fixing portion 25 to its position.

The metallic shell 2 having attached thereto the plate-like lock and hold-down member 21 contacts an electrically conducting nut-like member 13 via projections 14 which are provided on the internal surface of the metallic shell 2. Projections 28 are formed on each of the wing pieces 22 of the plate-like lock and hold-down member 21. Therefore, the nut-like member 13 is in contact with one of the wing pieces 22 of the plate-like lock and hold-down member 13. In this arrangement, the connector is placed on the printed wiring board 16, and two pieces of branched pieces 24, 24 are inserted into a throughgoing hole 18 in the printed wiring board 16 to engage the locking projections 23 with an edge of the throughgoing hole 18 and are thereafter soldered thereto with a solder 29. In addition, the board-fixing portion 25 is soldered to an electrically conducting portion 30 of the printed wiring board 16 with a solder 30. The metallic shell 2 is thus electrically connected to the electrically conducting portions 20, 30 of the printed wiring board 16 and thereby grounded via the nut-like member 13, the two pieces of branched pieces 24 of the plate-like lock and hold-down member 21, and the board-fixing portion 25.

Figure 8:
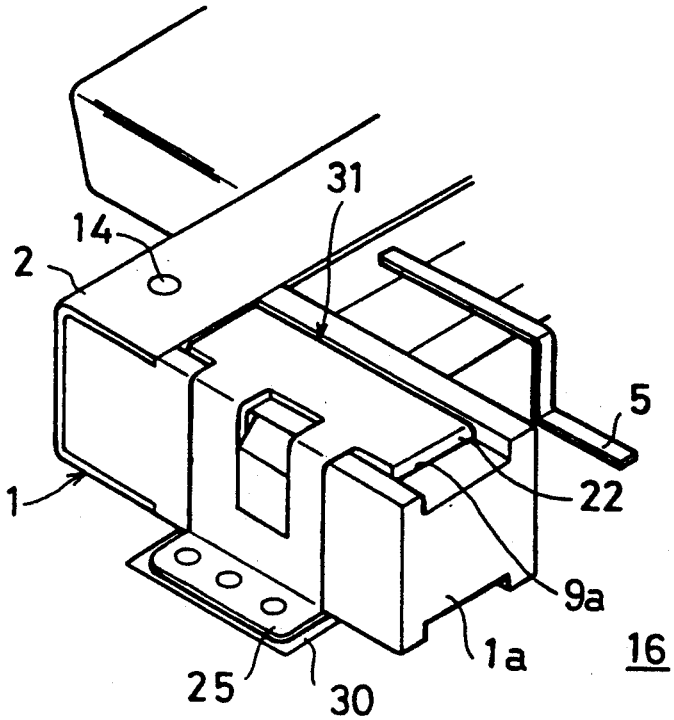
FIG. 8 is a perspective view of an important portion of another embodiment of the connector of this invention, in which a plate-like hold-down member, a nut, and a bolt are used for mounting the connector on a printed wiring board.
Figure 9:
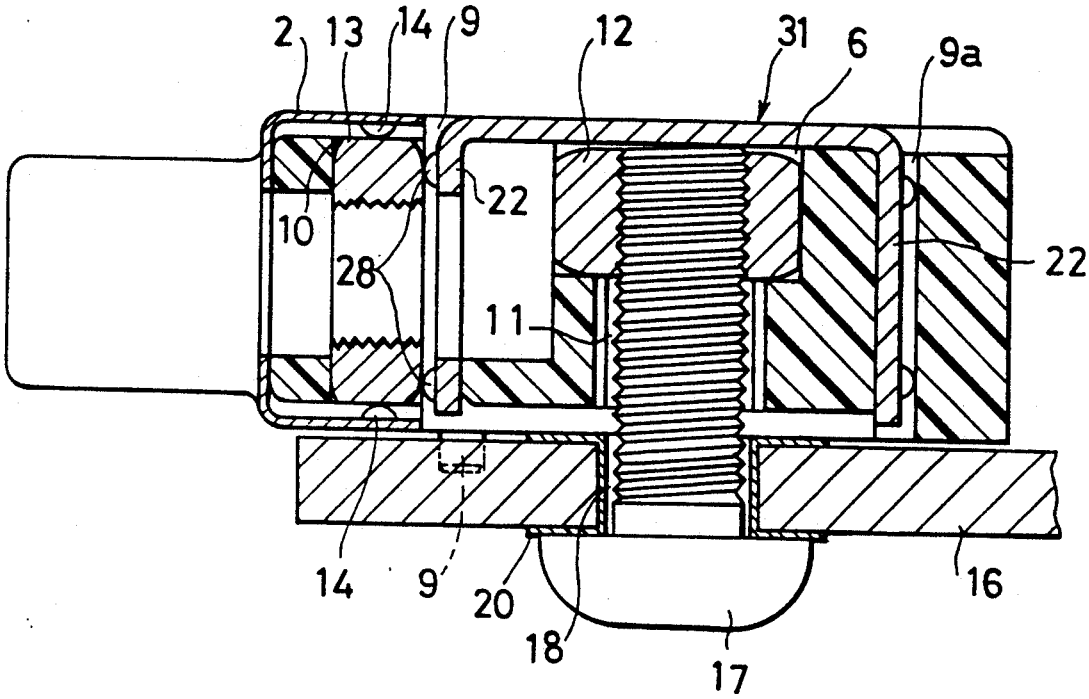
FIG. 9 is a sectional view of an important portion of the embodiment shown in FIG. 8.

FIGS. 8 and 9 show a still another embodiment of the connector of this invention, in which a plate-like hold-down member, a bolt, and a nut are used.

The plate-like hold-down member 31 is made up of a metallic plate and has, on both ends of one direction, a pair of parallelly provided wing pieces 22, 22 and, on one of the remaining ends of another direction which is at right angles to the above-mentioned direction, a board-fixing portion 25 (i.e., a portion for fixing the connector to the printed wiring board). The plate-like hold-down member 31 is mounted on the connector main body 1 by inserting the pair of parallelly provided wing pieces 22, 22 into the perforations 9, 9a in the connector main body 1. This plate-like hold-down member 31 has the same construction as that of the plate-like lock and hold-down member 21 except that the board-locking portion has been taken away. Instead of the board-locking portion, a nut 12 and a bolt 17 are used. Also in this embodiment, the metallic shell 2 contacts an electrically conductive nut-like member 13 via projections 14 which are provided on the internal surface of the metallic shell 2. Projections 28 are formed on the wing pieces 22. Therefore, the nut-like member 13 is in contact with one of the wing pieces 22 of the plate-like hold-down member 31. In this arrangement, the connector is placed on the printed wiring board 16, and the board-fixing portion 25 is soldered to an electrically conducting portion 30 of a printed wiring board 16. The metallic shell 2 is thus electrically connected to the electrically conducting portion 30 of the printed wiring board 16 and thereby grounded via the nut-like member 13, the wing piece 22 of the plate-like hold-down member 31, and the board-fixing portion 25.

Figure 11:
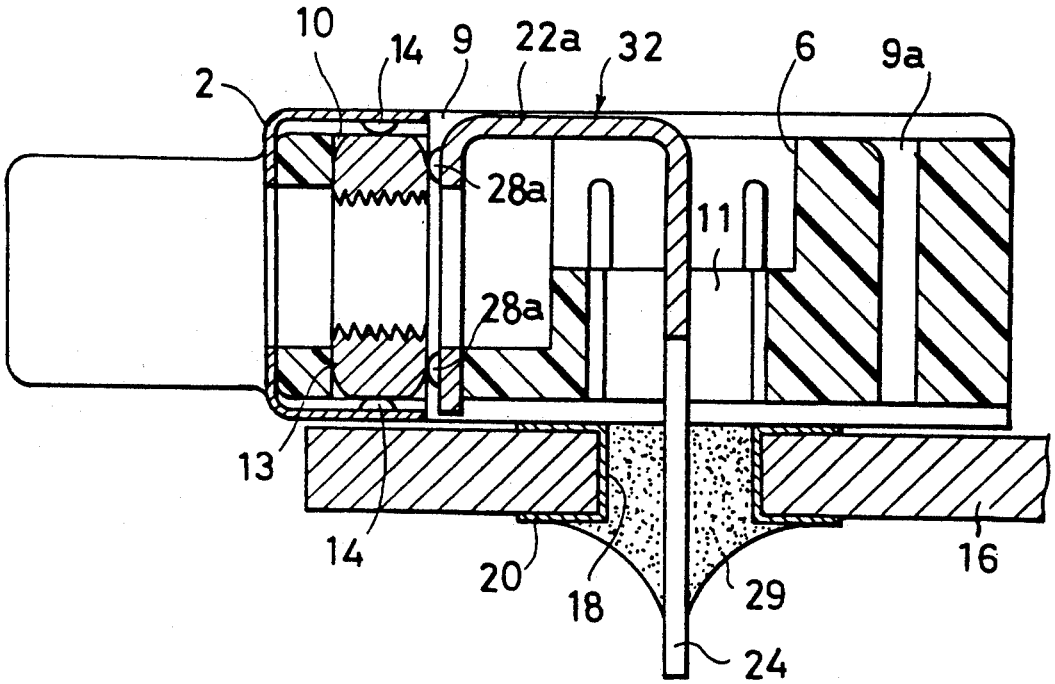
FIG. 11 is a sectional view of an important portion of the embodiment shown in FIG. 10.
Figure 10:
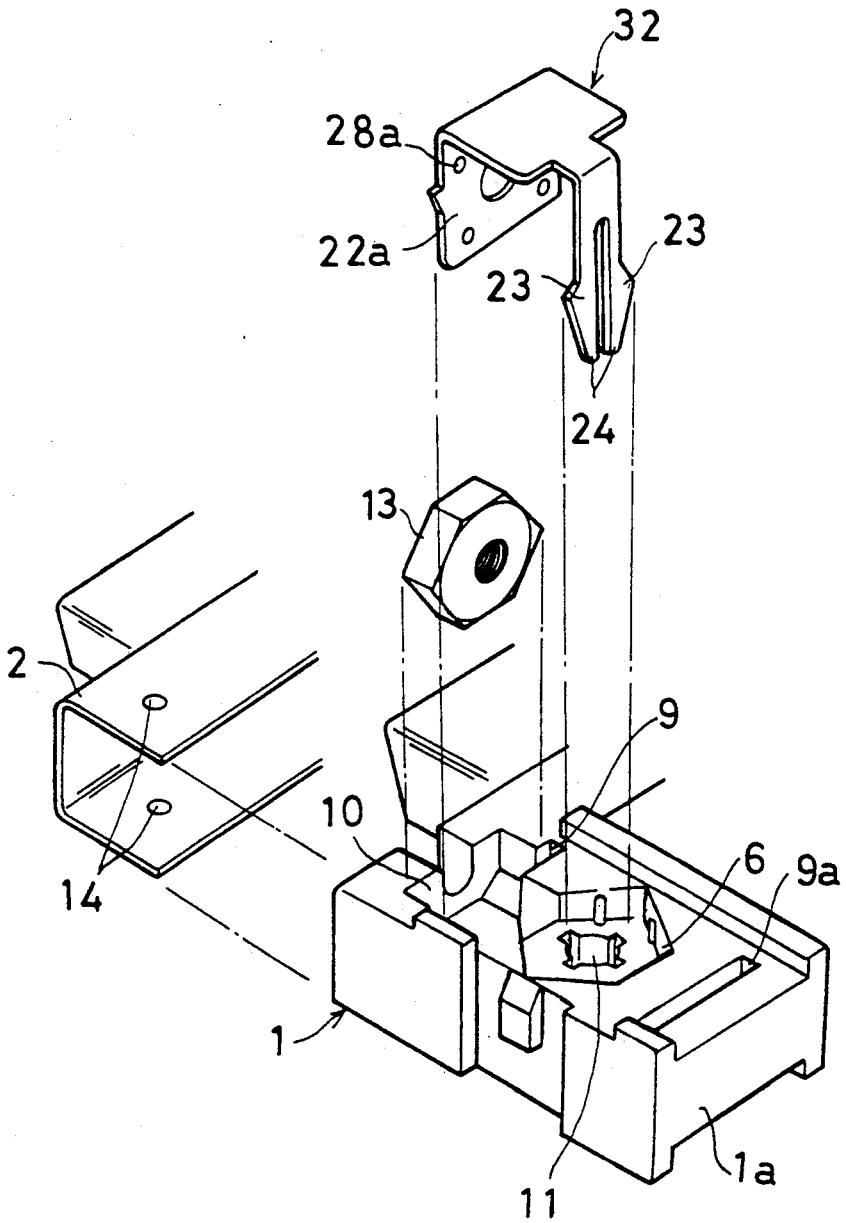
FIG. 10 is an exploded perspective view of an important portion of another embodiment of the connector of this invention, in which a plate-like lock member is used for mounting the connector on a printed wiring board.
Figure 12:
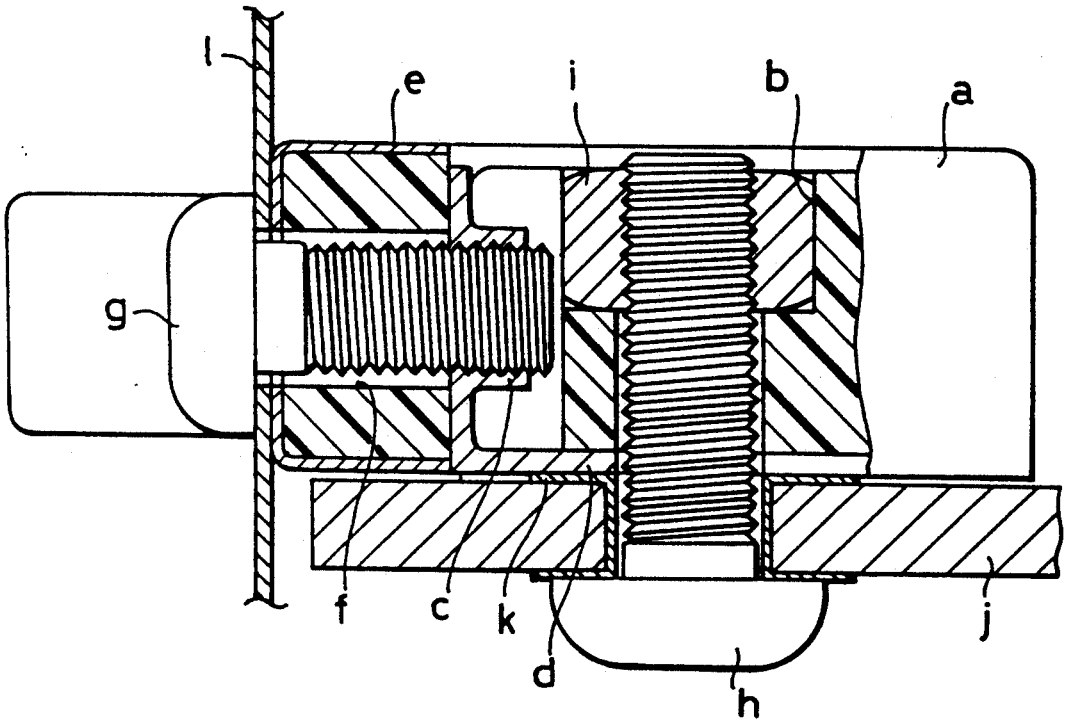
FIG. 12 PRIOR ART
FIG. 12 is a sectional view of a conventional connector.

FIGS. 10 and 11 show a still another embodiment of the connector of this invention, in which a plate-like lock member is used for mounting the connector on a printed wiring board.

The plate-like lock member 32 is bent into a U-shape. It has on one end a board-locking portion (i.e., a portion for locking the connector to the printed wiring board) comprising two pieces of branched pieces 24, 24 which are provided on each of their outer sides with a locking projection 23, 23, and has on the other end a connector main body fixing portion 22a (i.e., a portion for fixing the connector main body to the printed wiring board). This plate-like lock member 32 is fixed to the connector main body 1 by inserting the connector main body fixing portion 22a into the perforation 9. Also in this embodiment, the metallic shell 2 contacts an electrically conductive nut-like member 13 via projections 14 which are provided on the internal surface of the metallic shell 2. Projections 28a are formed on the connector main body fixing portion 22a. Therefore, the nut-like member 13 is in contact with the connector main body fixing portion 22a of the plate-like lock member 32. In this arrangement, the connector is placed on a printed wiring board 16, and two pieces of branched pieces 24, 24 of the board-locking portion are inserted into a throughgoing hole 18 in the printed wiring board 16 to engage the locking projections 23 with an edge of the throughgoing hole 18 and are thereafter soldered thereto with a solder 29. The metallic shell 2 is thus electrically connected to the electrically conducting portions 20 of the printed wiring board 16 and thereby grounded via the nut-like member 13, the connector main body fixing portion 22a and the board-locking portion.

As described above, according to this invention, the metallic shell of the connector is electrically connected to the electrically conductive nut-like member which is fitted into the perforation in the connector main body and the electrically conductive plate-like material or an electrically conductive mounting member. When the connector is mounted on the printed wiring board, it is electrically connected to the electrically conductive portion of the printed wiring board and is grounded. Therefore, this connector has an advantage in that the cost thereof becomes lower than conventional ones.

The term electrically conductive nut-like member used herein should be understood to be inclusive not only of an ordinary nut, but also of such members having no threaded hole therein such, for example, as an electrically conductive disc, washer, or the like.

It is readily apparent that the above-mentioned metallic-shell-equipped connector has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A metallic-shell-equipped electrical connector comprising:

a connector main body having a pair of right and left mounting portions, each of said mounting portions having a perforation;

an electrically conductive nut-like member which is fitted into said perforation;

an electrically conductive plate member which is fitted into said perforation in contact with an end surface of said electrically conductive nut-like member and is disposed along a lower surface of said connector main body; and a metallic shell which is fitted onto a surface of said connector main body in contact with a periphery of said electrically conductive nut-like member.

2. A metallic-shell-equipped electrical connector comprising:

a connector main body having a pair of right and left mounting portions, each of said mounting portions having a perforation;

an electrically conductive nut-like member which is fitted into said perforation;

an electrically conductive mounting member comprising a connector main body fixing portion which is fitted into said perforation in contact with an end surface of said nut-like member; and a metallic shell which is fitted onto a surface of said connector main body in contact with a periphery of said electrically conductive nut-like member.

3. A metallic-shell-equipped connector according to claim 2:

wherein said electrically conductive mounting member is a plate-like lock and hold-down member which is integrally made up of a pair of wing pieces, a locking portion having two pieces of branched pieces provided on each of their outer sides with a locking projection, and a board-fixing portion;

wherein one of said pair of wing pieces is fitted into said perforation in contact with said electrically conductive nut-like member;

wherein said two pieces of branched pieces of said board-locking portion are electrically connected to an electrically conductive portion of a printed wiring board when said two pieces of branched pieces are inserted into a throughgoing hole in the printed wiring board and are engaged with an edge of said throughgoing hole by soldering; and wherein said board-fixing portion is electrically connected to said electrically conducting portion of the printed wiring board when said board-fixing portion is soldered to said electrically conducting portion.

4. A metallic-shell-equipped connector according to claim 2:

wherein said electrically conductive mounting member is a plate-like hold-down member which is integrally made up of a pair of wing pieces and a board-fixing portion;

wherein one of said pair of wing pieces is fitted into said perforation in contact with said electrically conductive nut-like member; and wherein said board-fixing portion is electrically connected to an electrically conductive portion of a printed wiring board when said board-fixing portion is soldered to said electrically conductive portion.

5. A metallic-shell-equipped connector according to claim 2:

wherein said electrically conducting mounting member is a plate-like lock member which comprises, on one end, a locking portion having two pieces of branched pieces provided on each of their outer sides with a locking projection and, on the other end, a connector main body fixing portion;

wherein said connector main body fixing portion is fitted into said perforation in contact with said electrically conductive nut-like member; and wherein said locking portion is electrically connected to an electrically conductive portion of a printed wiring board when said two pieces of branched pieces are fitted into a throughgoing hole in the printed wiring board and are engaged with an edge of said throughgoing hole by soldering.

* * * * *